US005156213A

United States Patent [19]

George et al.

[11] Patent Number: 5,156,213

[45] Date of Patent: Oct. 20, 1992

[54] WELL COMPLETION METHOD AND APPARATUS

[75] Inventors: Kevin R. George, Columbus; Flint R. George, Katy, both of Tex.; Sherman C. Minni, Inverurie, Scotland

[73] Assignee: Halliburton Company, Duncan, Okla.

[21] Appl. No.: 595,478

[22] Filed: May 3, 1991

[51] Int. Cl.[5] ..... E21B 43/116

[52] U.S. Cl. ..... 166/297; 166/55.1; 166/377; 175/4.52

[58] Field of Search ..... 166/377, 297, 55.1; 175/4.52, 4.54

[56] References Cited

U.S. PATENT DOCUMENTS

| | | | |
|---|---|---|---|
| 2,706,344 | 12/1972 | Vann | 166/297 |
| 2,749,849 | 6/1956 | Babcock | 102/20 |
| 2,799,224 | 7/1957 | Long | 102/20 |
| 2,853,944 | 9/1958 | Robertson | 102/20 |
| 2,873,675 | 2/1959 | Lebourg | 102/20 |
| 2,876,843 | 3/1959 | Huber | 166/55 |
| 2,906,339 | 9/1959 | Griffin | 166/35 |
| 2,981,185 | 4/1961 | Caldwell | 102/20 |
| 3,032,109 | 5/1962 | Corley et al. | 166/55.4 |
| 3,966,236 | 6/1976 | Vann | 285/39 |
| 4,066,282 | 1/1978 | Vann | 285/39 |
| 4,078,611 | 3/1978 | Vann | 166/297 |
| 4,122,899 | 10/1978 | Brieger | 166/297 |
| 4,526,233 | 7/1985 | Stout | 166/377 |
| 4,557,331 | 12/1985 | Stout | 166/297 |
| 4,614,156 | 9/1986 | Colle, Jr. | 102/312 |
| 4,694,878 | 9/1987 | Gambertoglio | 166/377 |
| 4,771,827 | 9/1988 | Barker et al. | 166/55.1 |
| 4,776,393 | 10/1988 | Forehand et al. | 166/55.1 |
| 4,815,540 | 3/1989 | Wallbillich, III | 166/377 |
| 4,905,759 | 3/1990 | Wesson et al. | 166/377 X |
| 5,025,861 | 6/1991 | Huber et al. | 166/297 |

FOREIGN PATENT DOCUMENTS 9025166.1 11/1990 United Kingdom .

*Primary Examiner*—Hoang C. Dang
*Attorney, Agent, or Firm*—James R. Duzan

[57] ABSTRACT

A monobore completion system where the well is completed using a tubing conveyed perforating completion system having an automatic gun release and support for the tubing conveyed perforating guns.

22 Claims, 4 Drawing Sheets

WELL COMPLETION METHOD AND APPARATUS

BACKGROUND OF INVENTION

This present invention relates to an improved method and perforating system for completing wells.

In the past, tubing conveyed perforating systems for use in completing wells have been conveyed into wells on a tubing or pipe string with the string left in position in the well during the perforating of the well. After the perforating of the well, the perforating guns may have disintegrated or may be retrieved, or may be released or dropped from the tubing or pipe string through the use of various techniques. Such typical prior art types of tubing conveyed perforating methods are described in U.S. Pat. Nos. 2,749,840, 2,873,675, 2,876,843, 2,853,944, 3,032,109, 2,799,224, 2,906,339, 2,981,185, 3,706,344, 3,966,236, 4,066,282, 4,557,331, 4,776,393 and 4,815,540.

Yet another type of prior art tubing conveyed perforating system which uses a monobore completion string in the completed well and does not result in any restriction in the flow area of the completion string is described in British Patent Application No. 902516.1. which is assigned to the assignee of the present invention.

However, the prior art tubing conveyed perforating systems used in the completion of wells which release the perforating guns to be dropped into the rat hole of the well bore suffer from the disadvantages of restricting the flow area of the production string, requiring the retrieval of apparatus which, in turn, requires the well to be killed, requiring a great length of rat hole in the well, requiring potentially expensive fishing operations for the retrieval of portions of the portions of the perforating apparatus from the well and restricting of the length of the string of perforating guns used in completing the well.

BRIEF SUMMARY OF THE INVENTION

The present invention relates to an improved method and perforating system for completing wells. The present invention uses a monobore completion system where the well is completed using a tubing conveyed perforating completion system having a releasable gun hanger for the tubing conveyed perforating guns.

The present invention will be better understood when the drawings are taken in conjunction with the detailed description of the invention hereafter.

DETAILED DESCRIPTION OF THE INVENTION

Figure 1:
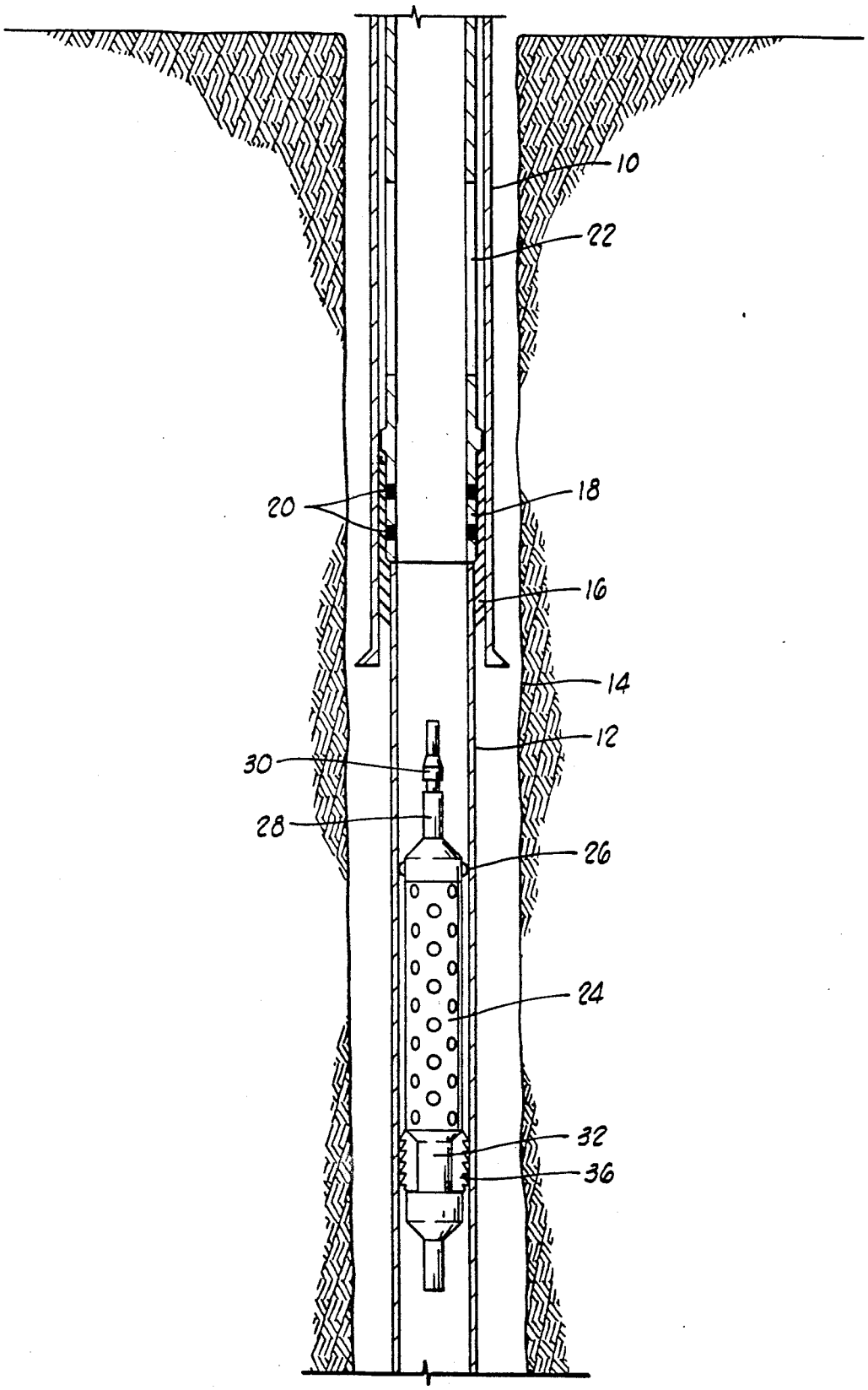
FIG. 1 is a cross-sectional view of the present invention in a well bore.

Referring to FIG. 1, a monobore completion system is shown where the well is completed using a tubing conveyed perforating completion system having an releasable gun hanger for the tubing conveyed perforating guns.

A well casing 10 having a liner 12 is shown in a well bore 14. The casing 10 and liner 12 are typically cemented in the well bore 14. Installed on the upper end of the liner 12 is a polished bore receptacle 16. The polished bore receptacle 16 may be of any suitable type, such as sold by Otis Engineering Corporation, Dallas, Tx. Additionally, the polished bore receptacle may be either installed on the upper end of the liner 12 or the lower end of the casing 10.

Engaging the polished bore of receptacle 16 is a tie-back seal assembly 18 having a plurality of seals 20 thereon, the tie-back seal assembly 18 being connected to the lower end of production pipe string 22 The tie-back seal assembly 18 may be of any suitable type such as sold by Otis Engineering Corporation, Dallas, Tx.

Further shown in FIG. 1 is a tubing conveyed perforating gun assembly 24 having a centralizer 26 thereon to centralize the perforating gun assembly 24 in the liner 12, a firing head 28 thereon, an on-off mandrel 30 on the upper end of the firing head 28, and a releasable gun hanger 32 connected to the lower end thereof. The on-off mandrel 30 may be of any suitable type which is capable of mating with a suitable on-off shoe (not shown) attached to the end of either a drill pipe work string (not shown) or tubing string (not shown) which is used to run the perforating gun assembly 24 having releasable gun hanger 32 thereon into the liner 12 to the desired location. At which time, the perforating gun assembly 24 is installed in the liner 12 and the drill pipe work string or tubing string is disconnected from the perforating gun assembly 24 and removed from the well.

The firing head 28 on the perforating gun assembly 24 may be of any suitable type, such as described in U.S. Pat. No. 4,614,156.

Figure 2:
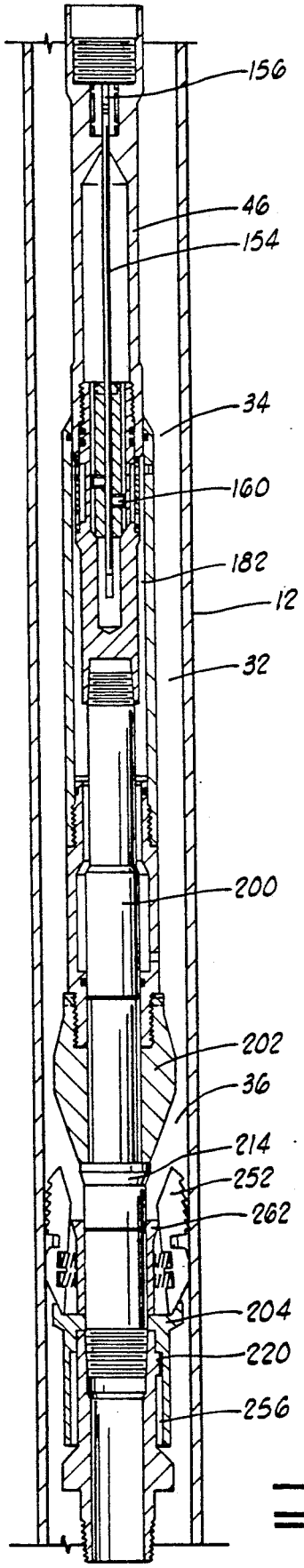
FIG 2 is a cross-sectional view of the releasable gun hanger of the present invention.

Referring to FIG. 2, the releasable gun hanger 32 is shown in the liner 12.

The releasable gun hanger 32 comprises an automatic gun release section 34 and support section 36. As shown in FIG. 2, the releasable gun hanger 32 has the support section 36 in its locked running position for running through the liner 12.

Figure 3:
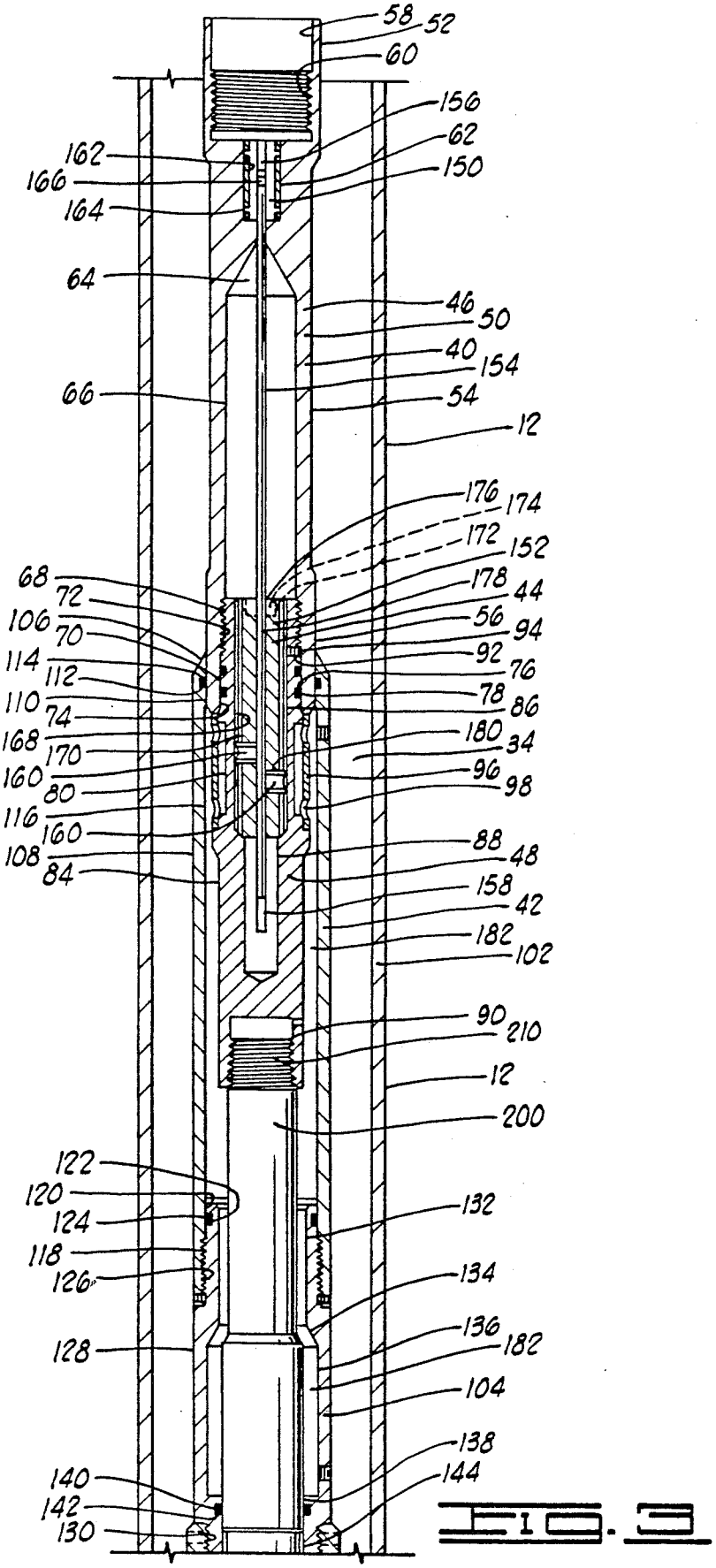
FIG. 3 is a cross-sectional view of a portion of the releasable gun hanger of the present invention.

Referring to FIG. 3, the automatic gun release section 34 is shown. The automatic gun release section 34 comprises a mandrel assembly 40, housing assembly 42 and explosive charge carrier assembly 44.

The mandrel assembly 40 comprises upper mandrel 46 and charge carrier mandrel 48. The upper mandrel 46 comprises an elongated annular cylindrical member having, on the exterior thereof, first cylindrical surface 52, second cylindrical surface 54 and third cylindrical surface 56 and having, on the interior thereof, first bore 58, first threaded bore 60, second bore 62, frusto-conical bore 64, third bore 66, second threaded bore 68 and fourth bore 70. Charge carrier mandrel 48 comprises an elongated annular cylindrical member having, on the exterior thereof, threaded surface 72 which threadedly engages second threaded bore 68 of upper mandrel 46, first cylindrical surface 74 having, in turn, a plurality of annular recesses 76 therein containing annular elastomeric seal means 78 therein which sealingly engage fourth bore 70 of upper mandrel 46, annular recess 80 therein, third cylindrical surface 84 and having, on the interior thereof, first bore 86, blind bore 88 and threaded recess 90 on the end thereof. The charge carrier mandrel 48 further includes threaded aperture 92 having, in turn, set screw 94 therein and spacer sleeve 96, located on first cylindrical surface 74 of mandrel 48 and having, in turn, a plurality of apertures 98 therein.

The charge carrier mandrel 48 is threadedly connected at its lower end to the upper end of support mandrel 200.

The housing assembly 42 comprises upper housing 102 and lower housing 104. The upper housing 102 comprises an elongated annular cylindrical member having, on the exterior thereof, frusto-conical surface 106 and cylindrical surface 108 and having, on the interior thereof, first bore 110 having, in turn, annular recess 112 therein containing annular elastomeric seal means 114 therein, which, in turn, slidingly, sealingly engage third cylindrical surface 56 of upper mandrel 46, second bore 116 and threaded bore 118.

Figure 4:
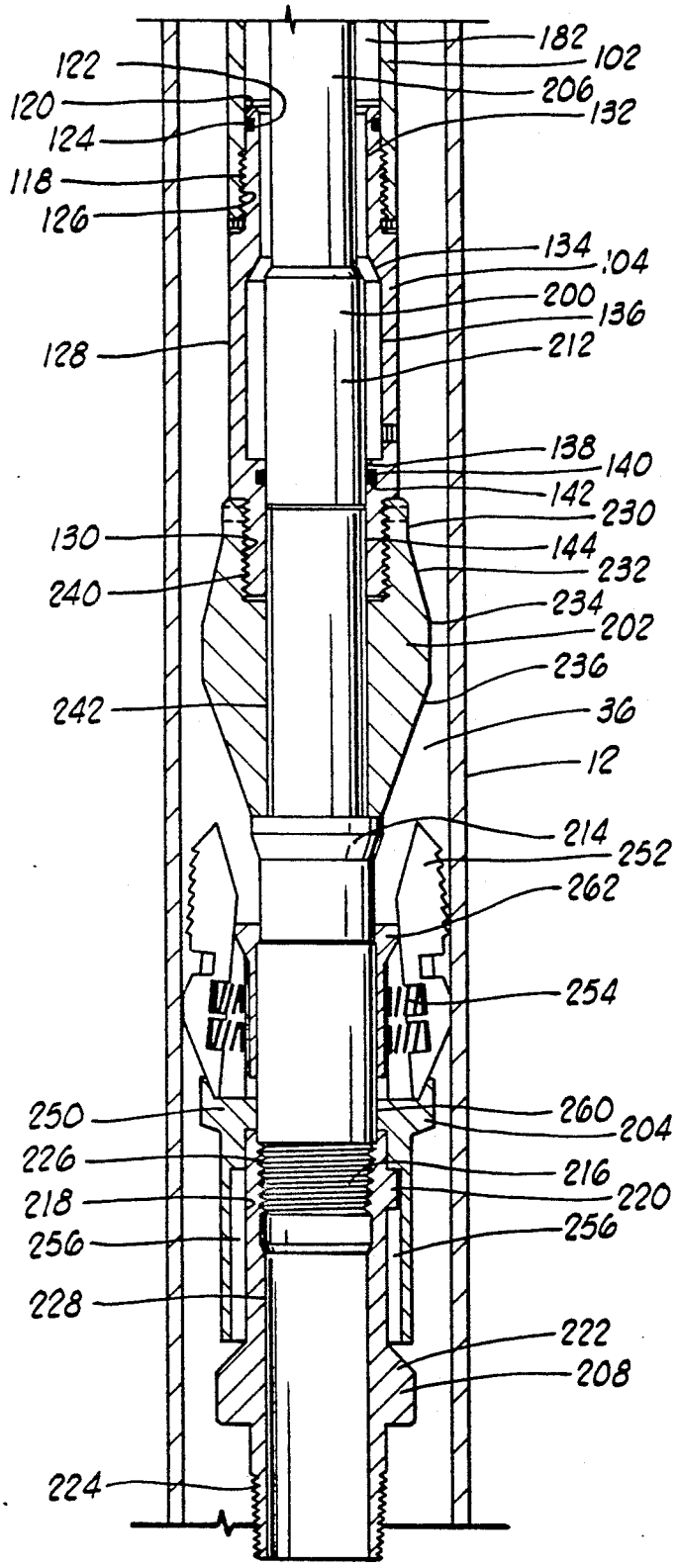
FIG. 4 is a cross-sectional view of a portion of the releasable gun hanger of the present invention.

Referring to FIGS 3 and 4, lower housing 104 comprises an elongated annular cylindrical member having, on the exterior thereof, first cylindrical surface 120 having, in turn, annular recess 122 containing annular elastomeric seal means 124 therein which, in turn, sealingly engage a portion of second bore 116 of upper housing 102, first threaded surface 126 which threadedly engages threaded bore 118 of upper housing 102, second cylindrical surface 128 and second threaded surface 130 and having, on the interior thereof, first bore 132, frusto-conical surface 134, second bore 136, third bore 138 having, in turn, annular recess 140 containing annular elastomeric seal means 142 therein, and fourth bore 144.

Referring again to FIG. 3, the explosive charge carrier assembly 44 comprises booster holder 150, charge carrier 152, detonating cord 154 having booster 156 on one end thereof and end seal 158 on the other end thereof, and a plurality of shaped explosive charges 160.

The booster holder 150 which is retained within second bore 62 of upper mandrel 46 comprises an annular cylindrical member having a cylindrical exterior surface 162 having annular lugs 164 thereon and bore 166 therethrough through which detonating cord 154 extends. Charge carrier 152 which is retained within first bore 86 of charge carrier mandrel 48 comprises an elongated annular cylindrical member having cylindrical exterior surface 168 having, in turn, fluid relief grooves 170 therein and having, on the interior thereof, threaded bore 172 threaded plug 174 therein having, in turn, bore 176 therein to receive the detonating cord 154 therethrough, bore 178 through which detonating cord 154 extends and a plurality of apertures 180 in which shaped explosive charges 160 are received. The charge carrier 152 is retained within charge carrier mandrel 48 by set screw 94 engaging exterior surface 168 of the carrier 152.

When assembled the annular cavity 182 between the mandrel assembly 40 and housing assembly 42 is filled with suitable oil, such as silicon oil, to present substantial movement of the releasable gun hanger until actuated.

Referring to FIG. 4, the support section 36 is shown. The support section 36 comprises support mandrel 200, slip wedge 202, and J-slot and slip assembly 204.

The support mandrel 200 comprises upper support mandrel 206 and slip mandrel 208. The upper support mandrel 206 comprises an elongated cylindrical member having a upper threaded end 210 (see FIG. 3) which threadedly engages threaded recess 90 of charge carrier mandrel 48, cylindrical seal section 212 which slidingly sealingly engages annular elastomeric seal means 142 of lower housing 104 to seal the lower end of annular oil filled cavity 182, annular slip wedge abutment 214 and lower threaded end 216. The slip mandrel 208 comprises an elongated annular cylindrical member having, on the exterior thereof, cylindrical surface 218, J-slot log 220, frusto-conical annular wedge 222, and threaded lower surface 224 and having, on the interior thereof, threaded bore 226 which threadedly engages lower threaded end 216 of upper support mandrel 206 and bore 228. The slip wedge 202 comprises an annular cylindrical member having, on the exterior thereof, first cylindrical surface 230, first frusto-conical annular surface 232, second cylindrical surface 234, and second frusto-conical annular slip surface 236 and having, on the interior thereof, threaded bore 240 which threadedly engages second threaded surface 130 of lower housing 104 and bore 242 through which a portion of upper support mandrel 206 extends. The J-slot and slip assembly 204 comprises a slip retainer housing 250 having, in turn, a plurality of cantilevered slips 252 resiliently mounted thereon by means of springs 254 which also bias the slips 252 against liner 12 and a conventional J-slot 256 in which the J-slot lug 220 on slip mandrel 208 moves to allow the setting of the releasable gun hanger 32 in the liner 12. The J-slot and slip housing 250 includes a central bore 260 and frusto-conical annular abutment surface 262

The J-slot and slip assembly 204 and slip mandrel 208 can be of any conventional commercially available type, such as sold by Baker Hughes, Inc., Houston, Tx.

OPERATION OF THE INVENTION

Referring to FIG. 1, the perforating system and method of completing wells will be described.

The well bore is drilled and has a casing 10 and liner 12 typically cemented therein having either the liner 12 or casing 10 having, in turn, a polished bore receptacle 16 installed thereon. A production pipe string 22 having a seal assembly 18 on the end thereof is run into the casing 10 with the seal assembly 18 being installed in the polished bore receptacle 16 thereby preparing the well to be completed by perforating and to be immediately placed on production.

Subsequent to the production pipe string 22 being run into the well, the perforating gun 24 having a releasable gun hanger 32 connected thereto is run into the liner 12 with the support section 36 being actuated to support the perforating gun 24 in the liner 12. At this time, the tubing string is disconnected from the perforating gun 24 at the on-off connector 30 and pulled from the well.

At this point, the well has the production pipe string 22 installed therein, is ready for production, and the perforating gun 24 supported in the liner 12 at the desired point so that the perforating gun 24 may be actuated to perforate the liner 12, the cement sheath surrounding the liner 12 and the surrounding formation to be produced through the liner 12 and production pipe string 22.

It should be understood that, if desired, the perforating gun 24 and releasable gun hanger 32 may be installed in the liner 12 prior to the production pipe string 22 having seal assembly 18 on one end thereof is installed in polished bore receptacle 16. Also, the perforating gun 24 either may be located by any suitable method in the liner 12, or may comprise any number of perforating guns from one to eighty (80) or more.

Referring to FIGS. 1 and 2, the operation of the releasable gun hanger 32 will be set forth. The releasable gun hanger 32 is connected to the perforating gun bottom end tandem by threading upper mandrel 46 thereto. In this manner, the booster 156 connected to the end of the detonating cord 154 will be adjacent the booster in the tandem on the bottom of the perforating gun to be actuated thereby.

To set the releasable gun hanger 32, it is necessary to unlock the J-lug 220 on slip mandrel 208 from the short leg of the J-slot 256 in the J-slot and slip assembly 204. To unlock the J-lug 220, weight is picked up from the tubing string, perforating gun 24 and release and support 36 while a right hand torque is applied to the string. This causes relative movement between the J-slot and slip assembly 204 and the slip mandrel 208 as slips 252 remain biased into engagement with liner 12. After weight has been picked up from the tubing string, perforating gun 24 and release and support 36, right hand torque is still applied to the tubing string, perforating gun 24 and release and support 36 to cause the J-lug 220 to move into the long leg of the J-slot 256 of the J-slot and slip assembly 204 with weight then being set down to cause the J-lug 220 to move through the long leg of the J-slot 256. When this occurs, since the release portion 34 is hydraulically locked due to the annular chamber 182 being oil filled, the slip wedge 202 is pushed downward into engagement with slips 252 to wedge the slips 252 into the liner 12 thereby allowing the weight of the tubing string, perforating gun 24 and releasable gun hanger 32 to be carried by the slips 252 and slip wedge 202. When the weight of the perforating gun 24 is being carried by the releasable gun hanger 32, the tubing string is disconnected from on-off connector 30 and removed from the well. At this time, the perforating gun 24 is ready to be actuated.

If a firing head 28 is a pressure activated time delay type, such as described in U.S. Pat. No. 4,614,156, the fluid pressure in the casing 10 and liner 12 is increased to actuate the firing head 28, then bled off to either a pressure level equal to the hydrostatic fluid pressure of the formation to be perforated, or a pressure level less than the hydrostatic fluid pressure of the formation to be perforated, or a pressure level greater than the hydrostatic fluid pressure of the formation to be perforated.

After actuation, the firing head 28 will cause detonation of the perforating charges in the perforating gun 24 and actuate the releasable gun hanger 32 to release the perforating gun 24 to drop to the bottom of the liner 12, the rat hole of the well.

Since the releasable gun hanger 32 is secured to the bottom tandem of the perforating gun 24, after the last perforating charge in the gun 24 has fired and the detonating cord has actuated the booster in the bottom tandem of the gun 24, the booster 156 and detonating cord 154 are actuated thereby causing shaped charges 160 to detonate rupturing charge carrier mandrel 48 in a plurality of locations. Once charge carrier mandrel 48 has been perforated, oil from annular chamber 182 may flow into upper mandrel 46 and the charge carrier mandrel 48. The weight of the perforating gun 24 bearing down on upper mandrel 46 which is now free to move causes support mandrel 200 to move downwardly which, in turn, causes slip wedge abutment 214 to engage surface 262 of slip retainer housing 250 to push slips 252 downwardly off slip wedge 202 thereby releasing slips 252 from liner 12 allowing the perforating guns to be released and move downwardly through liner 12 to the bottom thereof, automatically.

Since the firing head 28 of the perforating gun 24 contains on-off connector 30 secured thereto, if desired, tubing having a mating on-off tool shoe thereon may be run into the well to retrieve the perforating gun 24 and releasable gun hanger 32 from the well.

Although it is preferred that the releasable gun hanger 32 be installed on the bottom of the perforating gun 24, it could be installed on the top thereof with simple modifications.

It will be appreciated that the present invention offers an improved completion technique and apparatus for wells. It will be further appreciated that the present invention offers changes, additions and modification which are within its scope, such as placing the releasable gun hanger on the top of the perforating gun, placing the polished bore receptacle on either the top of the liner or bottom of the casing, using other types of firing heads on the perforating gun, use of wireline to run the perforating gun and releasable gun hanger into the well, use of rupture discs instead of explosive charges to release the oil from the chamber to actuate the releasable gun hanger, etc.

Having thus described my invention, we claim:

1. A method of perforating a formation in a well bore having fluid therein using a perforating gun having a support means attached thereto, the method of comprising the steps of:

conveying said perforating gun into said well bore using a conveying means having a portion thereof releasably attached to said perforating gun;

supporting said perforating gun in said well bore adjacent said formation using said support means to engage a portion of said well bore to allow said fluid in said well bore to be capable of flowing around said perforating gun and said support means attached thereto by orienting said support means below said perforating gun;

removing the conveying means from said well bore while said perforating gun remains supported in said well bore adjacent said formation to be perforated; and actuating said perforating gun to perforate said formation.

2. The method of claim 1 further comprising the step of:

discontinuing the supporting of said perforating gun after the actuation thereof by disengaging said support means attached to said perforating gun from said well bore.

3. The method of claim 1 wherein the conveying of said perforating gun into said well bore is accomplished using a string of conduit.

4. The method of claim 1 further comprising the step of:

disconnecting the conveying means from said perforating gun prior to the removal of the conveying means from said well bore while said perforating gun remains supported in said well bore adjacent said formation to be perforated.

5. The method of claim 1 further comprising the step of:

centering said perforating gun in said well bore.

6. The method of claim 1 further comprising the step of:

producing fluid from said formation after the perforation thereof.

7. The method of claim 1 further comprising the step of:

flowing said fluid from said well bore into said formation after the perforation thereof.

8. The method of claim 1 further comprising the step of:

installing a receptacle in said well bore above said perforating gun prior to the perforation of said formation; and installing a production pipe string in said well bore having one end sealingly engaging the receptacle in said well bore.

9. A method of perforating a formation in a well bore having a conduit and fluid therein using a perforating gun having a support means attached thereto, the method comprising the steps of:

conveying said perforating gun into said well bore using a conveying means having a portion thereof releasably attached to said perforating gun;

supporting said perforating gun in said conduit in said well bore at a position adjacent said formation using said support means to engage a portion of said conduit in said well bore to allow said fluid in said well bore to be capable of flowing around said perforating gun and said support means attached thereto by orienting said support means below said perforating gun;

removing the conveying means from said well bore while said perforating gun remains supported in said conduit in said well bore at a position adjacent said formation to be perforated; and actuating said perforating gun to perforate said conduit and a portion of said formation.

10. The method of claim 9 further comprising the step of:

terminating the supporting of said perforating gun after the actuation thereof by disengaging said support means attached to said perforating gun from said conduit in said well bore.

11. An automatic perforating gun release and support apparatus for supporting said perforating gun in a wall bore and releasing said perforating gun for movement is said well bore after the actuation thereof, said apparatus comprising:

annular housing means having a bore therethrough;

mandrel means slidably received within a portion of the annular housing;

slip support section means for engaging a portion of said well bore after the actuation thereof, the slip support section means having a portion thereof connected to a portion of the annular housing means and having a portion thereof engaging the mandrel means; and explosive charge means for perforating the mandrel means after the actuation thereof to allow relative movement between the housing means and the mandrel means to cause the slip means to disengage from said well bore.

12. The apparatus of claim 11 further comprising:

slid wedge means connected to the annular housing means for wedging the slip means into engagement with said well bore.

13. The apparatus of claim 11 wherein the explosive charge means comprise:

explosive booster means;

detonating cord means actuated by the explosive booster means; and explosive shaped charge means actuated by the detonating cord means for perforating the mandrel means.

14. The apparatus of claim 11 further comprising:

liquid filling a portion of the annular cavity formed between the annular housing and the mandrel means slidably received within a portion of the annular housing means, the liquid preventing any substantial movement of the mandrel means relative to the annular housing means until the explosive charge means perforate the mandrel means.

15. The apparatus of claim 11 wherein the mandrel means comprise:

an upper mandrel having one end thereof secured to said perforating gun and a cavity formed therein; and a charge carrier mandrel having one end thereof secured to the other end of the upper mandrel and a cavity formed therein.

16. The apparatus of claim 15 further comprising:

a charge carrier retained within the cavity of the charge carrier mandrel.

17. The apparatus of claim 15 further comprising:

a booster holder retained within the cavity in the upper mandrel.

18. The apparatus of claim 11 wherein the annular housing means comprises:

an annular upper housing having a portion of the upper end thereof slidingly sealingly engaging a portion of the mandrel means; and a lower annular housing having the upper end thereof secured to the lower end of the annular upper housing.

19. The apparatus of claim 18 further comprising:

slip wedge means having a portion thereof secured to the lower end of the lower annular housing.

20. The apparatus of claim 11 wherein the slip support section means comprise:

an annular J-slot and slip assembly;

an annular slip wedge; and a support mandrel extending through the annular slip wedge and the annular J-slot and slip assembly.

21. The apparatus of claim 20 wherein the annular J-slot and slip assembly comprises:

annular slip retainer housing having a bore therethrough having, in turn, a J-slot therein into the annular slip retainer housing;

a plurality of cantilevered slips retained on the annular slip retainer housing; and spring biasing means resiliently biasing the plurality of cantilevered slip with respect to the annular slip retainer housing.

22. The apparatus of claim 20 wherein the support mandrel comprises:

an upper support mandrel having an annular slip wedge abutment thereon for abutting a portion of the annular slip wedge and having a portion extending through the annular slip wedge and a portion of the annular J-slot and slip assembly; and a slip mandrel having the upper end thereof secured to the lower end of the upper support mandrel, having at least on J-slot lug thereon for engaging a portion of the J-slot and slip assembly and having an annular wedge on a portion thereof.

* * * * *